United States Patent [19]

Douglas

[11] 4,027,776

[45] June 7, 1977

[54] RECLOSEABLE CONTAINER

[75] Inventor: David Douglas, Indian Wells, Calif.

[73] Assignee: Avon Products, Inc., Indian Wells, Calif.

[22] Filed: July 31, 1975

[21] Appl. No.: 600,274

[52] U.S. Cl. ..... 220/281; 215/296; 215/301; 215/317; 215/355; 220/307

[51] Int. Cl.[2] ..... B65D 43/10

[58] Field of Search ..... 220/307, 281; 215/296, 215/301, 363, 355, 354, 317

[56] References Cited

UNITED STATES PATENTS

| | | | |
|---|---|---|---|
| 2,859,786 | 11/1958 | Tupper | 150/.5 |
| 2,985,354 | 5/1961 | Aldington | 229/43 |
| 3,460,711 | 8/1969 | Roy | 220/307 |
| 3,559,843 | 2/1971 | Kern | 220/281 |
| 3,743,131 | 7/1973 | Croyle et al. | 220/281 |

FOREIGN PATENTS OR APPLICATIONS

| | | | |
|---|---|---|---|
| 515,347 | 11/1952 | Belgium | 215/355 |
| 742,544 | 9/1966 | Canada | 215/301 |
| 1,158,278 | 7/1969 | United Kingdom | 215/355 |

*Primary Examiner*—William Price
*Assistant Examiner*—Joseph M. Moy
*Attorney, Agent, or Firm*—Pennie & Edmonds

[57] ABSTRACT

A resealable container comprising container means and closure means adapted to sealingly cooperate with said container means, said container means having a sidewall with at least one open end portion defining an opening, said open end portion having first sealable means for enabling the formation of two separate and positive seals substantially about the periphery of said open end portion, said closure means including, in integral combination, a generally peripheral shoulder portion being adapted to be seated on said open end portion, a flange portion connected to said shoulder portion and defining second sealable means for sealingly interfitting and cooperating with said first sealable means to provide the two separate and positive seals, and flexible means for enabling quick and easy engagement and disengagement of the two separate and positive seals formed by said first and second sealable means in response to displacement of the flexible means.

16 Claims, 6 Drawing Figures

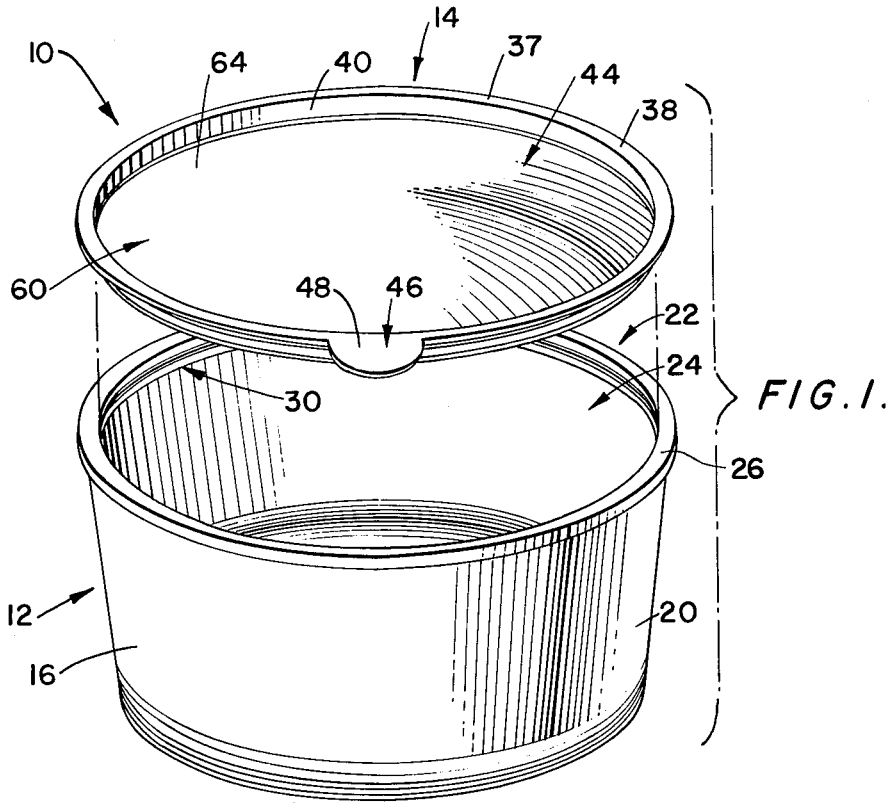
FIG. 1.
FIG. 2.
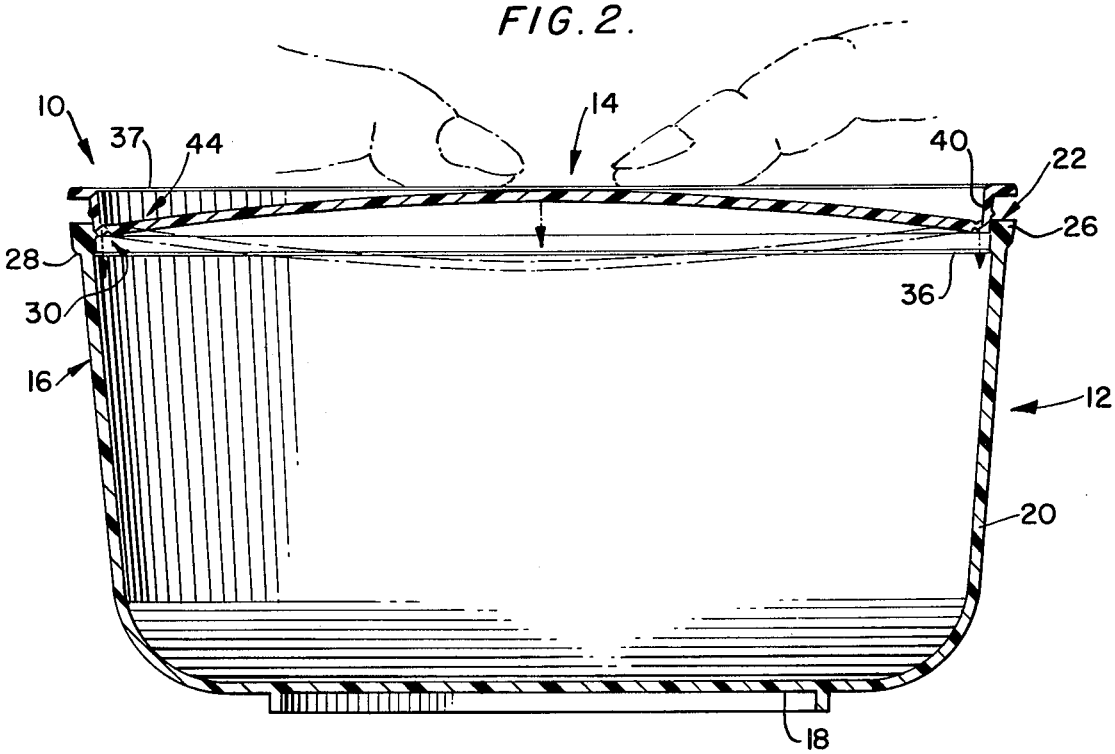

RECLOSEABLE CONTAINER

BACKGROUND OF THE INVENTION

1. Field of the Invention

This particular invention generally pertains to containers for storing various types of goods or the like. More specifically, it is directed to a resealable container which provides a novel and improved double sealing arrangement that produces audible sounds at least for indicating that the double seals are properly positioned and effected.

2. Description of the Prior Art

It is a rather widespread commercial and industrial practice to store a variety of goods or the like in recloseable containers. Typically, these containers are comprised of a bowl-shaped container member having at least an open end, and removably associated therewith a closure member or lid. Normally, the closure member has relatively flexible characteristics, and is appropriately formed so as to have interfitting surfaces which usually cooperate with corresponding cooperating surfaces on the container to produce a snap-on type fit. The foregoing type of interfitting and cooperating relationship, however, ordinarily provides for only a single seal. Such seal, as is conventional, essentially serves the conventional purposes of preventing spoilage of the contents in the container and, in certain instances, undesired fluidic leakage into and from the container for well-known purposes.

Heretofore, there have been numerous forms of prior art constructions for providing the noted interfitting and cooperating relationship between the container and closure lid members of the above category. Often, many of these prior art constructions have interfitting and cooperating surfaces which are rather complicated in configuration and somewhat costly in production. Moreover, such category of prior art containers failed to furnish effective seals, especially through repeated usage. In addition, such container members and closure members were generally difficult to quickly and easily disassemble and reassemble. It is, of course, apparent that if a perfect or effective seal was not attained, the container would correspondingly be unsatisfactory for its intended use and thereby fail to perform its intended function.

Aside from the foregoing enumerated disadvantages, the typical prior art container constructions did not furnish any means for quickly, easily, and reliably indicating to a user that the closure member was properly received within and by the container member, and the corresponding sealing relationship was properly effected.

Attempts have been made to generally improve upon the effectiveness of the typical prior art container seal relationships by providing a container having a relatively simply constructed interfitting and cooperating surfaces which provided for the seal. By way of specific example, an attempt to provide for such an improved resealable container is generally described in U.S. Pat. No. 2,850,786. The type of resealable container described in the above particular patent includes a plastic open ended container having an outer rim which is slidably insertable within a corresponding groove formed in the removable closure member. While this type of container was generally considered an improvement, it, however, normally only provided for a single seal between the closure lid and container member.

Moreover, while a double gasket arrangement is taught, the attainment of such a double seal is only achieved whenever a particular type of material is utilized, as opposed to any constructional arrangement of the interfitting and cooperating bowl and lid. Apart from the foregoing shortcoming the flexible closure lid member is not as easily removable or replaceable as could otherwise be commercially desired. An additional drawback in the above described seal relationship was the fact that a user did not have an automatic and convenient method for easily ascertaining whether or not the seal was completely formed.

Other attempts to improve upon the foregoing type of seal arrangement have resulted in the manufacture of containers which enable the formation of at least double mechanical type seals between the closure lid member and container member. Although these attempts, such as described in U.S. Pat. Nos. 2,985,354 and 3,460,711, provide for a plurality of seals between the mating containers and closure members, they nevertheless are subject to several disadvantages. Among such disadvantages are the fact that the closure lid members are somewhat complicated in construction and manufacture. In addition, they are, in general, not as easily removable or replaceable as could otherwise be commercially desired. Moreover, in using this lattery category of container, a user would not, in an easy fashion, be able to automatically and accurately ascertain whether or not the interfitting and cooperating surfaces of the lid and container had formed adequate and effective seals.

Other flexible containers have been proposed, such as described generally in U.S. Pat. No. 3,743,131, which essentially provide for a pop-top type of closure lid which produces an audible sound. The foregoing described container, however, suffers from the disadvantage in that only a single seal is provided which may not, under all circumstances, be able to provide the type of sealing that might be desired in certain situations.

In view of the foregoing comments directed to the various prior art constructions of resealable containers, it will be appreciated that such heretofore known prior art containers do not provide for a container which has an effective double seal arrangement between closure lid and container, as well as facilitates the easy and quick attachment and detachment of the lid to the closure member in a simple, economical, and reliable manner. Moreover, the prior art does not provide a container of the foregoing type that provides audible sounds which indicate that a proper seal engagement has been effectuated and broken.

SUMMARY OF THE INVENTION

Accordingly, it is an object of the present invention to overcome the aforementioned shortcomings associated with the use of prior art containers, particularly those containers which are fabricated from flexible material, by providing a novel and improved resealable container having a positive double seal arrangement between the closure member and container member which double seal is quickly and easily engaged and disengaged. In addition, this invention provides for an audible sound during the opening and closing of the container for the purposes of indicating that the seals have been respectively properly formed or broken.

Briefly, in accordance with the present invention there is provided a resealable container which comprises container means and closure means adapted to sealingly cooperate with said container means. The container means has a sidewall with at least one open end portion defining an opening. Such open end portion has a first sealable means for enabling the formation of two separate and positive seals substantially about the periphery of the open end sections. The closure means, as contemplated by the instant invention, includes in integral combination, a generally peripheral shoulder portion which is adapted to be selectively seated on the open end portion, a flange portion connected to the shoulder portion and defining second sealable means for sealingly interfitting and cooperating with the first sealable means to provide the two separate and positive seals, and flexible means for enabling quick and easy disengagement of the two separate and positive seals formed by the first and second sealable means in response to displacement of the flexible means.

In a preferred embodiment, the closure and container means are so formed that the first and second sealing means produce audible sounds during assembly of the closure and container means, thereby indicating that both seals have been properly formed, and during the disassembly of the closure and container means, thereby indicating that both seals have been broken.

BRIEF DESCRIPTION OF THE DRAWING

The above, as well as other objects, features, and advantages of the present invention will become evident from a reading of the detailed description of a preferred embodiment made in accordance with the principles of the present invention when view in conjunction with the accompanying drawings wherein like reference numerals indicate like structure throughout the several views.

FIG. 1 is an exploded perspective view illustrating the pop-top, resealable container embodying the principles of the present invention;

FIG. 2 is a cross-sectional side view illustrating a manner by which a closure lid member is inserted into engagement with the open-mouthed rim portion of a suitable correspondingly shaped container also made in accordance with the present invention;

DETAILED DESCRIPTION

Figure 3:
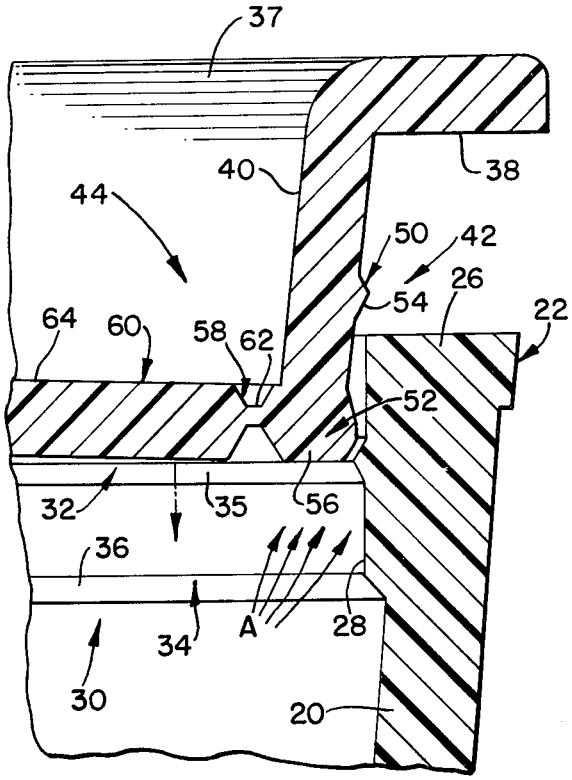
FIG. 3 is a somewhat enlarged fragmented sectional side view illustrating in greater detail the position of the interfitting and cooperating surfaces of both the closure lid and container members of the present invention during insertion of the former into the latter.
Figure 4:
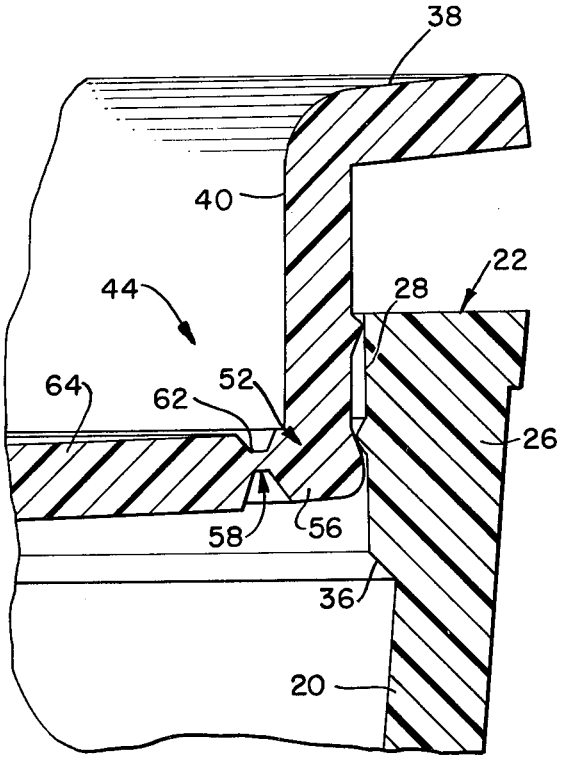
FIG. 4 is a view which is similar to FIG. 3 but, however, illustrating in greater detail another sequence of cooperation between the interfitting and cooperating surfaces of this invention.

Referring now to the drawings and, in particular, to FIG. 1, there is depicted a resealable container embodying the principles of the present invention and being designated generally by reference numeral 10. Resealable container 10 may be used for a wide variety of industrial and commercial purposes and products, such as for storing food stuffs and the like, whenever it is desired to prevent spoilage of the contents held by the resealable container 10, as well as any undesired leakage into and therefrom. Essentially, resealable container 10 comprises container means 12 and closure lid means 14. The closure means 14, in a manner to be presently described, will operatively sealingly cooperate with the container means 12 to form unique and novel double positive seals.

It will, of course, be further understood that the container means 12 can assume a variety of configurations and dimensions without departing from the spirit and scope of the present invention. In the embodiment being described, the container means 12 is basically defined by a container or bowl member 16 having a generally circular shape. The bowl member 16 may be comprised of a typically generally flat and closed bottom end 18, generally upwardly and outwardly extending annular sidewall 20, and an open end portion 22 opposite closed end 18. Open end portion 22 generally defines a circular opening 24 and includes an outer rim portion 26 having a generally smooth internal peripheral surface 28. Open end portion 22 further, includes a first or interfitting and cooperating sealable means being indicated by reference numeral 30. Essentially described, the interfitting and cooperating sealable means 30 serves the purpose of enabling the formation of two separate and positive seals with closure means 14.

As perhaps best viewed in FIG. 1, taken in combination with FIGS. 2 to 6 the first interfitting and cooperating sealable means 30 includes a first ridge means 32 and first shoulder means 34. The first ridge means 32 basically comprises a ridge member 35 extending radially inwardly and substantially about the otherwise generally smooth internal peripheral surface 28 of outer rim portion 26. As depicted, first ridge member 35 has a generally V-shaped configuration. Inwardly disposed from the top of outer rim portion 26 is the first shoulder means 34. First shoulder means 34 is defined by generally annular and inclined shoulder surface 36 which slopes downwardly and radially outwardly from inner peripheral surface 28. Preferably, the material from which the container member 16 may be fabricated is a relatively high durometer, semi-flexible polyolefin, such as polypropylene of high density polyethylene. The particular significance of the container member 16 possessing a relatively high durometer will be subsequently described in the succeeding description of the invention. It should be understood, however, that other materials which possess similar chemical and physical characteristics could likewise be used without departing from the spirit and scope of the present invention.

As best shown in FIGS. 1 and 2, closure lid means 14 is seen to be comprised of a closure lid member 37 having, in integral combination, shoulder portion 38, flange portion 40 which defines second interfitting and cooperating sealable means 42, flexible means 44, and closure lifting means 46.

Figure 5:
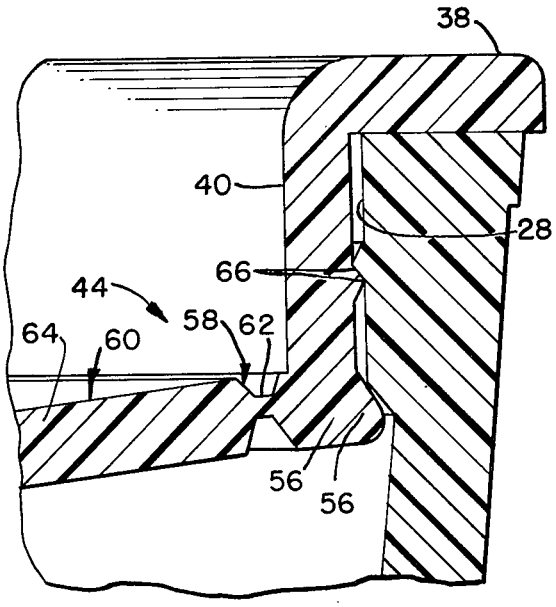
FIG. 5 is a view which is substantially similar to FIGS. 3 and 4 but, however, illustrating the cooperation between the interfitting and cooperating sealing surfaces of the closure lid and container members whenever the latter are in their assembled condition.

In the illustrated embodiment, the shoulder portion 38 extends laterally outwardly about the peripheral extent of lid member 37. It is configured so as to be seated upon the top of outer rim portion 26, whenever both container means 12 and the closure means 14 are in their assembled condition, such as illustrated in FIG. 5. The flange portion 40 is connected to shoulder portion 38 and extends generally vertically and downwardly with respect thereto. As illustrated in FIG. 1, closure lifting means 46 is shown as being comprised of a typical lateral tab member 48 which projects laterally outwardly. Tab member 48, in the normal manner, functions to facilitate easy removal of closure lid means 14.

Figure 6:
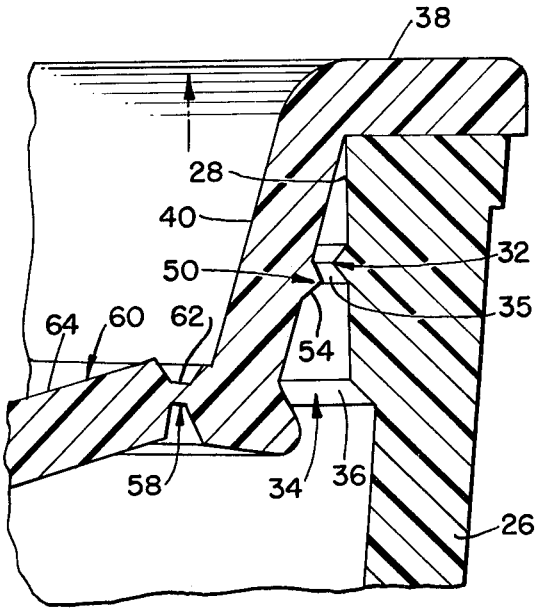
FIG. 6 is a view similar to FIG. 5 but, however, illustrating disengagement between the interfitting and cooperating sealing surfaces of the closure lid and container members as such members are being separated during an opening operation.

In regard to the second interfitting and cooperating sealable means 42, such is perhaps more precisely illustrated in FIGS. 2 and 6. As depicted, second interfitting and cooperating sealable means 42 includes second ridge means 50 and bead means 52. In connection with second ridge means 50, it is defined by a radially outwardly extending ridge member 54 which substantially extends about the periphery of closure lid member 37. As shown, ridge member 54 has a generally V-shaped external configuration which is similar to that of ridge member 35. In the assembled or sealed condition as best shown in FIG. 5, both ridge members 35 and 54 frictionally interlock together to form a positive seal which is impervious to leakage of liquids, as well as tends to diminish leakage of air. Whenever in this interlocking relationship, it will be observed that ridge member 54 of container lid member 37 is situated beneath ridge member 35. While the preceding description has basically disclosed the ridge members 35 and 52 as having a generally V-shaped configuration, it will be understood, of course, that other similar configurations may also be utilized without departing from the the spirit and scope of this invention.

With respect to the bead means 52, such is best depicted in FIGS. 3 to 6. As noted, bead means 52 is formed by a generally enlarged peripheral bead member 54 which extends about the peripheral extent of closure lid means 14. Bead member 56 is formed at the base of the flange portion 40 so as to outwardly protrude therefrom. In a manner to be subsequently explained bead member 56 is adapted to selectively frictionally contact and sealingly cooperate with annular shoulder surface 36 of first shoulder means 34 so as to effect a second fluid impervious or water-tight seal which also tends to diminish leakage of air.

With respect to flexible means 44, continued reference is made to FIGS. 2 to 6. As depicted, flexible means 44 includes toggle type hinge means 58, and central displaceable actuating means 60 is defined by resilient central wall portion 64.

Toggle hinge means 58 is defined by a peripherally extending central web portion 62 which interconnects the bead member 56 to the central displaceable actuating means 60. The central web portion 62 has a thickness which is less than the cross-sectional thicknesses of the adjacent central actuating means 60 and bead means 52. The essential purpose served by the toggle hinge means 58 is to facilitate variances in the relative dimension of the outside diameter of the closure lid member 37 as measured with respect to the bead member 56. As will be subsequently explained, by virtue of these changes in outside diameter, the engagement as well as disengagement of the double seals formed by the first and second interfitting and cooperating means 30 and 42, respectively, will be easily effected. The toggle hinge means 58 permits the selective increase and decrease in the effective diameter of the lid member 37 which diameter is measured through the horizontal plane that includes the peripheral extent of the bead member 56. It should be pointed out that the lid member 37 whenever in its normal undeformed and generally convex condition has the effective diameter of the peripheral bead member less than it would be if the central wall portion 64 was in its dead center or flat position. In this dead center position it will be understood that the central wall portion 64 is in a generally horizontal position such that the peripheral bead member 56, toggle hinge 58 and central wall portion 64 generally fall within the same generally horizontal plane. It can, of course, be appreciated that in this particular dead center position, the effective outside diameter of the lid member 37, which is measured along bead member 56 is at its maximum dimension. Accordingly, it follows then that whatever the central wall portion 64 flexes to those positions which are away from this generally horizontal position the effective diameter of the lid member will correspondingly decrease.

Now referring to the resilient displaceable central wall portion 64. As best shown by the solid lines in FIG. 2, the central portion 64 normally has a generally convex shape, wall portion 64, as also depicted by the phantom lines in FIG. 2 is adapted to be displaceable to a generally concave position so as to enable the engagement of the two positive seals in a manner to be presently described. Moreover, as will be afterwards explained, displacement of wall portion 64 facilitates an improved and easy removal of the lid member 37 from the container member 16.

It is envisioned by the present invention that the closure lid means 14 be manufactured from a suitable plastic material. In particular, it has been determined that a semi-flexible polyolefin, such as polypropylene or high density polyethylene may also be successfully utilized. This type of plastic material has a memory which will enable it to return to the original generally convex position from any position including the flexed and depressed concave conditions illustrated by the phantom lines in FIG. 2 and the solid lines in FIGS. 4 to 6. Moreover, the plastic material for the container lid member 37, as the container member 16, should likewise have a relatively hard durometer. It will be appreciated, of course, that other material having similar chemical and physical characteristics may also be used in connection with the present invention. By virtue of the fact that the container and container lid members 16 and 37, respectively, have a relatively hard durometer they, whenever assembled or disassembled, will enable effectuation of audible sounds. Specifically, such audible sounds are arranged to occur as the positive seals are in the process of being engaged and disengaged. In addition, the durometer range should, of course, be appropriately selected so as to provide for the audible sounds.

Having thus described the aforenoted constructional arrangement of the novel and improved resealable container 10 of the present invention, its mode of assembly and disassembly will be presently described. To close the container 10, by having the container lid member 37 cooperate with the container member 16, all that a user basically has to accomplish is to insert the flange portion 40 within the open end portion 22, such that two positive friction seals result from the first and second interfitting and cooperating sealing means 32 and 42 being respectively brought into engagement.

The sequence of operational steps required to successfully perform this particular end is best viewed in FIGS. 2 through 6. Referring specifically now to FIG. 2 taken in conjunction with FIGS. 3 to 5, the central wall portion 64 is normally gradually downwardly deformed from its standard generally convex position, indicated by solid lines in FIG. 2, to a generally concave position shown by phantom lines in FIG. 2. Preferably, the downward manual pressure is applied on and around the center of the central wall portion 64. During the course of this downward application of pressure, the bead means 52 is initially adapted to engage and bypass the second ridge member 54. Accordingly, since both the container member 16 and lid member 37 are fabricated from a semi-flexible material having a relatively hard durometer, an audible "pop" noise is correspondingly produced. This sound will appropriately indicate to a user that the bead member has successfully passed the top or first ridge member 35. Such movement of the bead member 56 over ridge member 35 is facilitated by action of the toggle hinge means 58 which better enables bending of such bead member 56.

With continued reference to the closing operation the continued downward movement of the lid member 37 will also result in the second ridge member 54 of container lid member riding over the first ridge member 35, such that opposing mating surfaces 66 of each of the ridge members 35 and 54 are interlocked in an interfitting and cooperating relationship. As depicted, a relatively constant line contact is obtained through this relationship. Consequently, in this particular manner, a relatively long-lasting first positive friction type seal is obtained. Conjointly, with this latter action the bead member 56 will be moving somewhat radially outwardly in response to the central wall portion 64 being depressed and formed into a slightly concave position as indicated in FIG. 5. Whenever in this concave position, which is slightly below the dead center or flat position of central wall portion 64, the peripheral bead member 56 will be practically in a condition such that the effective diameter thereof is at its maximum. By this particular arrangement the peripheral bead member 56 is able to tightly engage the annular shoulder surface 36.

In addition, and as perhaps more precisely shown in FIG. 3, whenever the container lid member 37 is forced into the open end portion 22 of container bowl member 16, a certain amount of air will be displaced from the space within the bowl member. Such displaced air, indicated by arrows A, will tend to escape about the peripheral extent of the lid member 37 during this inward forcing action. Consequently, at least a partial vacuum is created within the bowl member 16. This partial vacuum tends to keep the central wall portion 64 in the slightly concave position it assumes whenever in the assembled condition. The combination of the partial vacuum, and the fact that the annular shoulder surface 36 contacts the peripheral bead member 56, serves to overcome the inherent resiliency of the container lid member 37 to return to its original unflexed and convex position as shown in FIGS. 1 and 2. It should be pointed out that the toggle hinge means 58, also enables the engagement between the peripheral bead member 56 and shoulder surface 36 without interrupting the formation of the positive seal between the first and second interlocking and cooperating ridge members 35 and 54, respectively. This is by reason of the fact that toggle hinge means 58 allows a flexing to occur between peripheral bead 56 and annular ridge member 54 on the container lid member 37. As a consequence of the foregoing operations, a second positive friction seal is attained. The resulting double seal of resealable container 10 provides an extremely effective water-tight seal.

Moreover, a second "pop" or "snap" type sound is audible as both the first and second interlocking and cooperating ridge members 35 and 54, respectively, and peripheral bead member 56 and shoulder surface 36 become engaged. Thus, a user of the resealable container 10 will be automatically and reliably informed that both positive friction seals have been adequately and successfully achieved. Additionally, the double seals are effected through the application of very slight downward pressure upon deformable central wall portion 64.

By reason of the aforenoted constructional arrangement, the positive arrangement of double seals is accomplished in a quick, easy and convenient manner. Although the container lid member 37 could theoretically be inserted within the bowl member and the seals formed by applying pressure about the rim of the lid member, the present invention is particularly designed to be effectuated through a quick and simple relatively downward application of pressure on and around the center of the generally convex lid member 37.

To remove the lid member 37 from the bowl member 16, all that a user need do is to further depress the central wall portion 64, from the slightly concave position, as shown in FIG. 5, to a position having even greater concavity such as illustrated in FIG. 6. Since the central wall portion 64 is moving away from the generally horizontal plane position, the effective diameter of peripheral bead 56 will be correspondingly decreased. As a result of such action, both the respective first and second interlocking ridges members 35 and 54, as well as the peripheral bead member 56 and annular shoulder surface 36 will disengage. Simultaneously with this action, the tab member 48 is grasped and upwardly pulled for enabling the lid member 37 to be easily lifted. Concurrently, another double pop type sound becomes audible which serves the purpose of automatically indicating to the user that both seals have been broken. Although, of course, the tab member 48 can be exclusively used to remove the container lid member 37 from the container member 16 without the necessity for depressing central portion 64, it has been found that through the depression of the central wall portion 64, such removal is significantly enhanced. Accordingly, by depressing the central wall portion 64 an extremely easy removal operation is able to be performed.

It will be appreciated that through the foregoing arrangement of components the achievement of two positive water-tight friction seals is able to be attained in an extremely easy and reliable manner which requires very little effort on the behalf of the user. In addition, the provision of audible sounds which occur during the sealing action reliably indicate to a user that both seals have been adequately and effectively formed. Moreover, the constructional arrangement of the foregoing resealable container is simple in construction, since it does not need an elaborate arrangement of correspondingly curved and bent surfaces to form effective seals.

While the invention has been described with a preferred embodiment, it is not intended to limit the invention to the particular form set forth, but, on the contrary, it is intended to cover such alternatives, modifications, and equivalents as may be included within the spirit and scope of the invention defined by the appended claims.

What is claimed is:

1. A resealable container comprising container means and closure means sealingly cooperating with said container means, said container means having a sidewall with at least one open end portion defining an opening, said open end portion having first sealable means for enabling the formation of two separate and positive seals substantially about the periphery of said open end portion, said closure means including, in integral combination, a generally peripheral shoulder portion being seated on said open end portion, a flange portion connected to said shoulder portion and defining second sealable means for sealingly interfitting and cooperating with said first sealable means to provide the two separate and positive seals, said second sealable means including bead means sealingly interfitting and cooperating with said first sealable means for defining one of said two seals, and flexible means for enabling quick and easy disengagement and engagement of the two separate and positive seals formed by said first and second sealable means, said flexible means includes a generally displaceable actuating means and toggle hinge means including a web portion having a thickness less than the adjacent actuating means and bead means and being arranged to be centrally interconnecting said displaceable actuating means to said bead means, such that in response to downward displacement of said actuating means said toggle hinge means including a web portion increases the effective diameter of said bead means so that said bead means engages said first sealable means, said bead means whenever engaged with said first sealable means in the assembled position forms one of said two seals and said toggle hinge means including a web portion enables said bead means to have the effective diameter thereof decreased in response to further downward displacement of said actuating means from the assembled position so that said second sealable means including said bead means and said first sealable means are disengaged to thereby break open both said seals.

2. A container as set forth in claim 1 in which said first sealable means includes first ridge means adjacent the opening and substantially extending about the peripheral extent of said open end portion for enabling formation of the first of the two separate seals, and first shoulder means vertically disposed from said first ridge means and substantially extending about the peripheral extent of said open end portion for enabling formation of the second of the two seals.

3. A container as set forth in claim 2 in which said second sealable means includes a second ridge means which extends substantially about the periphery of said flange for sealingly interfitting and cooperating with said first ridge means for forming the first seal, and bead means for sealingly interfitting and cooperating with said first shoulder means to define the second seal of the two seals.

4. A container as set forth in claim 1 in which said displaceable actuating means is defined by a generally convex central wall portion.

5. A container as set forth in claim 2 in which said first ridge means is formed by a first inwardly directed ridge member which extends substantially about an internal peripheral surface of said open end portion.

6. A container as set forth in claim 2 in which said first shoulder means is formed by a generally downwardly and radially outwardly inclined shoulder surface that extends between an internal peripheral surface of said open end portion and said sidewall.

7. A container as set forth in claim 5 in which said first ridge member has a generally V-shaped configuration.

8. A container as set forth in claim 3 in which said second ridge means is formed by a radially outwardly directed second ridge member which substantially extends about said flange means, and said bead means includes a bead-like protuberance which substantially extends about the bottom of said flange means.

9. A container as set forth in claim 8 in which said second ridge member has a generally V-shaped configuration.

10. A container as set forth in claim 1 in which said container and closure means are fabricated from a high density polyethylene.

11. A container as set forth in claim 1 in which said container and closure means are fabricated from polypropylene.

12. A container as set forth in claim 1 in which said container means is fabricated from high density polyethylene and said closure means is fabricated from polypropylene.

13. A container as set forth in claim 1 in which said container means and said closure means are fabricated from suitable plastic materials which have a memory to thereby enable them to return to an undeformed condition.

14. A container as set forth in claim 13 in which said plastic material is comprised of a semi-flexible polyolefin material.

15. A container as set forth in claim 13 in which said closure and container means have durometers selected so as to produce audible sounds during engagement and disengagement of said first and second sealable means.

16. A resealable container comprising container means and closure means sealingly cooperating with said container means; said container means and said closure means comprised of a semi-flexible, polyolefin material; said container means having a sidewall with at least one open end portion defining an opening, said open end portion having first sealable means for enabling the formation of two separate and positive seals substantially about the periphery of said open end portion, said first sealable means includes first ridge means adjacent the opening and substantially extending about the peripheral extent of said open end portion for enabling formation of the first of the two separate seals, and said first sealable means includes first shoulder means vertically disposed from said first ridge means and substantially extending about the peripheral extent of said open end portion for enabling formation of the second of the two seals; said closure means including, in integral combination, a generally peripheral shoulder portion seated on said open end portion, a flange portion connected to said shoulder portion and defining second sealable means for sealingly interfitting and cooperating with said first sealable means to provide the two separate and positive seals, said second sealable means includes a second ridge means which extends substantially about the periphery of said flange for sealingly interfitting and cooperating with said first ridge means for forming the first seal, said second sealable means also including bead means for sealingly interfitting and cooperating with said first shoulder means to define the second seal of the two seals, and flexible means for enabling quick and easy disengagement of the two separate and positive seals formed by said first and second sealable means in response to displacement by said flexible means; said flexible means includes a generally displaceable actuating means and hinge means including a web portion having a thickness less than said adjacent actuating means and bead means and being arranged to be centrally interconnecting said displaceable actuating means to said bead means, such that in response to downward displacement of said displaceable actuating means said hinge means including a web portion increases the effective diameter of said bead means so that said bead means is adapted to engage said first shoulder means, said bead means remains engaged with said first shoulder means as a result of a partial vacuum being created in said container means in response to said closure means being inserted within said opening of said container means and the displacement of said displaceable actuating means, said bead means also remains engaged with said first shoulder means as a result of said first shoulder means contacting said bead means, said bead means whenever engaged with said first shoulder means in the assembled condition forms the second seal, and said hinge means including a web portion enables said bead means to have the effective diameter thereof decreased in response to further downward displacement of said displaceable actuating means from the position it assumes in the assembled condition, so that said bead means and said first shoulder means, as well as said first and second ridge means are disengaged to thereby open both seals.

* * * * *